US009590314B2

(12) United States Patent
Celik

(10) Patent No.: US 9,590,314 B2
(45) Date of Patent: Mar. 7, 2017

(54) CIRCULARLY POLARIZED CONNECTED-SLOT ANTENNA

(71) Applicant: Trimble Navigation Limited, Sunnyvale, CA (US)

(72) Inventor: Nuri Celik, Sunnyvale, CA (US)

(73) Assignee: Trimble Inc., Sunnyvale, CA (US)

( * ) Notice: Subject to any disclaimer, the term of this patent is extended or adjusted under 35 U.S.C. 154(b) by 165 days.

(21) Appl. No.: 14/587,641

(22) Filed: Dec. 31, 2014

(65) Prior Publication Data

US 2016/0190704 A1 Jun. 30, 2016

(51) Int. Cl.

| | |
|---|---|
| ***H01Q 9/04*** | (2006.01) |
| ***H01Q 15/00*** | (2006.01) |
| ***H01Q 1/38*** | (2006.01) |
| ***H01Q 13/10*** | (2006.01) |
| ***H01Q 5/40*** | (2015.01) |

(52) U.S. Cl.

CPC ..... *H01Q 15/0086* (2013.01); *H01Q 1/38* (2013.01); *H01Q 5/40* (2015.01); *H01Q 9/0428* (2013.01); *H01Q 9/0435* (2013.01); *H01Q 9/0464* (2013.01); *H01Q 13/10* (2013.01)

(58) Field of Classification Search

CPC ..... H01Q 15/0086; H01Q 1/38; H01Q 9/0428

USPC ..... 343/700 MS

See application file for complete search history.

(56) References Cited

U.S. PATENT DOCUMENTS

| | | | | |
|---|---|---|---|---|
| 4,208,660 | A * | 6/1980 | McOwen, Jr. | H01Q 9/0435 343/769 |
| 5,714,961 | A * | 2/1998 | Kot | H01Q 13/18 343/700 MS |
| 6,262,495 | B1 | 7/2001 | Yablonovitch et al. | |
| 6,597,316 | B2 * | 7/2003 | Rao | H01Q 9/0407 343/700 MS |

(Continued)

OTHER PUBLICATIONS

Jensen et al., "Coupled Transmission Lines as Impedance Transformer" IEEE Transactions on Microwave Theory and Techniques, vol. 55, No. 12, Dec. 2007, 9 pages.

(Continued)

*Primary Examiner* — Dameon E Levi
*Assistant Examiner* — David Lotter
(74) *Attorney, Agent, or Firm* — Kilpatrick Townsend & Stockton LLP

(57) ABSTRACT

A connected-slot antenna includes a dielectric substrate, a circular patch overlying the dielectric substrate, and a first conductive ring surrounding the circular patch and overlying the dielectric substrate. The first conductive ring is isolated from the circular patch by a first connected slot. At least four feeds are coupled to the circular patch. Each of the at least four feeds are spaced from adjacent ones of the at least four feeds by approximately equal angular intervals. A metamaterial ground plane includes a plurality of conductive patches and a ground plane. The plurality of conductive patches are separated from the circular patch and the first conductive ring by at least the dielectric substrate. The ground plane is electrically coupled to at least a first portion of the plurality of conductive patches. One or more of the plurality of conductive patches and the ground plane are coupled to ground.

19 Claims, 10 Drawing Sheets

(56) References Cited

U.S. PATENT DOCUMENTS

| | | | | |
|---|---|---|---|---|
| 6,847,328 | B1 * | 1/2005 | Libonati | H01Q 9/0407 343/700 MS |
| 7,446,712 | B2 * | 11/2008 | Itoh | H01Q 13/206 343/700 MS |
| 7,994,997 | B2 | 8/2011 | Livingston et al. | |
| 8,610,635 | B2 * | 12/2013 | Huang | H01Q 15/0086 343/700 MS |
| 2007/0285324 | A1 * | 12/2007 | Waterhouse | H01Q 1/273 343/718 |
| 2014/0028524 | A1 * | 1/2014 | Jerauld | H01Q 1/52 343/893 |

OTHER PUBLICATIONS

Rayno et al., "Dual-Polarization Cylindrical Long-Slot Array (CLSA) Antenna Integrated With Compact Broadband Baluns and Slot Impedance Transformers" IEEE Antennas and Wireless Propagation Letters, vol. 12, 2013, 4 pages.

Bian et al., "Wideband circularly polarised slot antenna," IET Microwaves, Antennas & Propagation, vol. 2, No. 5, Aug. 4, 2008, pp. 497-502, XP006031283; doi: 10.1049/iet-map:20070243.

Karmakar, N. C., "Investigations Into a Cavity-Backed Circular-Patch Antenna," IEEE Transactions on Antennas and Propagation, vol. 50, Dec. 1, 2002, pp. 1706-1715.

Payandehjoo et al., "Suppression of Substrate Coupling Between Slot Antennas Using Electromagnetic Bandgap Structures," Antennas and Propagation Society International Symposium, 2008, AP-S, 2008. IEEE, IEEE, Piscataway, NJ, USA, Jul. 5, 2008; pp. 1-4, XP31824233.

Ramirez et al., "Concentric Annular Ring Slot Antenna for Global Navigation Satellite Systems," IEEE Antennas and Wireless Propagation Letters, IEEE, Piscataway, NJ, US, vol. 11, Jan. 1, 2012, pp. 705-707, XP11489275.

Sun et at, "Design and Investigation of a Dual-Band Annular Ring Slot Antenna for Aircraft Applications," Progress in Electromagnetics Research C, vol. 38, Jan. 1, 2013, pp. 6778, XP055265587.

International Application No. PCT/US2015/067621, International Search Report and Written Opinion mailed Apr. 26, 2016, 14 pages.

* cited by examiner

CIRCULARLY POLARIZED CONNECTED-SLOT ANTENNA

FIELD OF THE INVENTION

Embodiments described herein relate generally to slot antennas, and more particularly, to broadband circularly polarized connected-slot antennas.

BACKGROUND

Conventional slot antennas include a slot or aperture formed in a conductive plate or surface. The slot forms an opening to a cavity, and the shape and size of the slot and cavity, as well as the driving frequency, contribute to a radiation pattern. The length of the slot depends on the operating frequency and is typically about $\lambda/2$ and inherently narrowband. Conventional slot antennas are linearly polarized and can have an almost omnidirectional radiation pattern. More complex slot antennas may include multiple slots, multiple elements per slot, and increased slot length and/or width.

Slot antennas are commonly used in applications such as navigational radar and cell phone base stations. They are popular because of their simple design, small size, and low cost. Improved designs are constantly sought to improve performance of slot antennas, increase their operational bandwidth, and extend their use into other applications.

SUMMARY

Embodiments described herein provide broadband circularly polarized connected-slot antennas. In an embodiment, the connected-slot is formed in a circular shape and includes multiple feed elements that can be phased to provide circular polarization. The connected-slot antennas can be configured for specific frequencies, wider bandwidth, and different applications such as receiving satellite signals at global navigation satellite system (GNSS) frequencies (e.g., approximately 1.1-2.5 GHz).

In accordance with an embodiment, a circularly polarized connected-slot antenna configured to receive radiation at GNSS frequencies includes a dielectric substrate, a circular patch overlying the dielectric substrate, and a first conductive ring surrounding the circular patch and overlying the dielectric substrate. The first conductive ring is separated from the circular patch by a first connected slot. At least four impedance transformers overly the dielectric substrate. Each of the at least four impedance transformers include a microstrip and a ground pad that are separated by a first dielectric. Each microstrip may be coupled to a first feed from a coaxial cable at an input and coupled to the circular patch at an output. Each ground pad may be coupled to a ground from the coaxial cable and coupled to the first conductive ring. The output associated with each microstrip is spaced from adjacent outputs associated with other microstrips by approximately equal angular intervals. A metamaterial ground plane includes a plurality of conductive patches arranged along a first plane and separated from the circular patch, the first conductive ring, and the at least four impedance transformers by at least the dielectric substrate. Each conductive patch is separated from others of the conductive patches. A ground plane is arranged along a second plane. The ground plane is electrically coupled to at least a first portion of the plurality of conductive patches. A conductive fence extends at least from the first plane to the second plane and extends around a perimeter of the plurality of conductive patches and around a perimeter of the ground plane. One or more of the plurality of conductive patches, the ground plane, and the conductive fence are coupled to ground.

In an embodiment, the circular patch and the first conductive ring each having a substantially circular shape.

In another embodiment, the circularly polarized connected-slot antenna also includes a second conductive ring surrounding the first conductive ring and overlying the dielectric substrate. The second conductive ring is separated from the first conductive ring by a second connected slot. A plurality of second feeds are coupled to the second conductive ring. Each of the plurality of second feeds are spaced from adjacent ones of the plurality of second feeds by approximately equal angular intervals.

In another embodiment, each microstrip includes at least two conductive traces. A first one of the at least two conductive traces has one end connected to the first feed and another end connected to the output of the microstrip. A second one of the at least two conductive traces has one end connected to the first feed and another end free from connection with a conductor. The first conductive trace and the second conductive trace extend substantially parallel to but separate from each other along multiple sections of the microstrip. Each section of the microstrip extends substantially perpendicular to an adjacent section of the microstrip.

In another embodiment, the ground plane is electrically isolated from at least a second portion of the plurality of conductive patches.

In another embodiment, the circular patch, the first conductive ring, and the at least four impedance transformers overly a top side of the dielectric substrate, and the plurality of conductive patches are disposed on a backside of the dielectric substrate.

In another embodiment, the circular patch includes at least four elongated sections extending radially outward from the circular patch and spaced at approximately equal angular intervals around the circular patch. Each of the at least four elongated sections are coupled to a microstrip at the output of the microstrip, and each microstrip is disposed outward beyond an end of an associated one of the at least four elongated sections.

In another embodiment, the circularly polarized connected-slot antenna also includes a second dielectric disposed between the plurality of conductive patches and the ground plane.

In another embodiment, the first dielectric comprises a dielectric disc, and the conductive patch and each microstrip overly the dielectric disc.

In another embodiment, the first dielectric comprises multiple dielectric plates, and each microstrip is separated from an associated ground pad by one of the multiple dielectric plates.

In another embodiment, a major surface of the conductive fence extends substantially perpendicular to the first plane and the second plane.

In yet another embodiment, the dielectric substrate and the ground plane are circular shaped, and the conductive fence extends around perimeters of the dielectric substrate and the ground plane.

In accordance with another embodiment, a connected-slot antenna includes a dielectric substrate, a circular patch overlying the dielectric substrate, and a first conductive ring surrounding the circular patch and overlying the dielectric substrate. The first conductive ring is coupled to ground and isolated from the circular patch by a first connected slot. At least four feeds are coupled to the circular patch. Each of the at least four feeds are spaced from adjacent ones of the at least four feeds by approximately equal angular intervals. A metamaterial ground plane includes a plurality of conductive patches and a ground plane. The plurality of conductive patches are arranged along a first plane and separated from the circular patch and the first conductive ring by at least the dielectric substrate. The ground plane is arranged along a second plane. The ground plane is electrically coupled to at least a first portion of the plurality of conductive patches. One or more of the plurality of conductive patches and the ground plane are coupled to ground.

In an embodiment, the connected-slot antenna includes at least four impedance transformers overlying the dielectric substrate. Each of the at least four impedance transformers include a microstrip and a ground pad that are separated by a first dielectric. Each microstrip is coupled to one of the at least four feeds, and each ground pad is coupled to ground.

In another embodiment, the connected-slot antenna includes a conductive fence extending at least from the first plane to the second plane and extending around a perimeter of the plurality of conductive patches and around a perimeter of the ground plane.

In another embodiment, the circular patch is electrically coupled to at least one of the plurality of conductive patches and to the ground plane by a via.

In yet another embodiment, the connected-slot antenna includes a second conductive ring surrounding the first conductive ring and overlying the dielectric substrate. The second conductive ring is isolated from the first conductive ring by a second connected slot. A plurality of second feeds are coupled to the second conductive ring. Each of the plurality of second feeds are spaced from adjacent ones of the plurality of second feeds by approximately equal angular intervals.

In accordance with yet another embodiment, an antenna configured to receive radiation at GNSS frequencies includes a dielectric substrate, a circular patch overlying the dielectric substrate, and a first conductive ring surrounding the circular patch and overlying the dielectric substrate. A first connected slot extends between the circular patch and the first conductive ring and separates the circular patch from the first conductive ring. At least four impedance transformers overly the dielectric substrate. Each of the at least four impedance transformers are coupled to a first input feed and coupled to the circular patch at an output. Each output is separated from adjacent outputs by approximately equal angular intervals. A metamaterial ground plane includes a plurality of conductive patches and a ground plane. The plurality of conductive patches are arranged along a first plane and separated from the circular patch, the first conductive ring, and the at least four impedance transformers by at least the dielectric substrate. The ground plane is arranged along a second plane. The ground plane is electrically coupled to at least a first portion of the plurality of conductive patches. One or more of the plurality of conductive patches and the ground plane are coupled to ground.

In an embodiment, the antenna includes a conductive fence extending at least from the first plane to the second plane and extending around a perimeter of the plurality of conductive patches and around a perimeter of the ground plane.

In another embodiment, the antenna includes a second conductive ring surrounding the first conductive ring and overlying the dielectric substrate. The second conductive ring is isolated from the first conductive ring by a second connected slot. A plurality of second input feeds are disposed in the second connected slot and coupled to the second conductive ring. Each of the plurality of second input feeds is separated from adjacent ones of the second input feeds by approximately equal angular intervals.

Numerous benefits are achieved using embodiments described herein over conventional techniques. By having a connected-slot structure with multiple feeds and phasing, a broadband circularly polarized antenna is obtained. This enables the reception of all GNSS signals, available worldwide, with a single antenna, resulting in significant cost and size savings. For example, some embodiments include connected-slot antennas that have a simple design and a relatively small size so that they can be produced economically. Also, in some embodiments, the connected-slot antennas are compact so that they can be used in mobile devices. These benefits are achieved while still having a large gain, good impedance matching, right hand circular polarized radiation with improved low-elevation angle sensitivity, and suppressed left hand circular polarization for multipath resilience in urban environments over a wide bandwidth. Depending on the embodiment, one or more of these benefits may exist. These and other benefits are described throughout the specification with reference to the appended drawings.

DETAILED DESCRIPTION

Embodiments described herein provide a broadband circularly polarized connected-slot antenna. In some embodiments, the connected-slot antennas include a circular patch surrounded by a conductive ring. At least four feeds may be disposed within a connected-slot that separates the circular patch from the conductive ring. The antennas may also include a metamaterial ground plane that includes conductive patches, a ground plane, and multiple vias connecting some of the conductive patches to the ground plane. In some embodiments, the metamaterial ground plane may also include a conductive fence extending around a perimeter of the conductive patches and the ground plane. The connected-slot antennas may be configured to operate over a wide bandwidth so that they can receive radiation at different GNSS frequencies.

Figure 1:
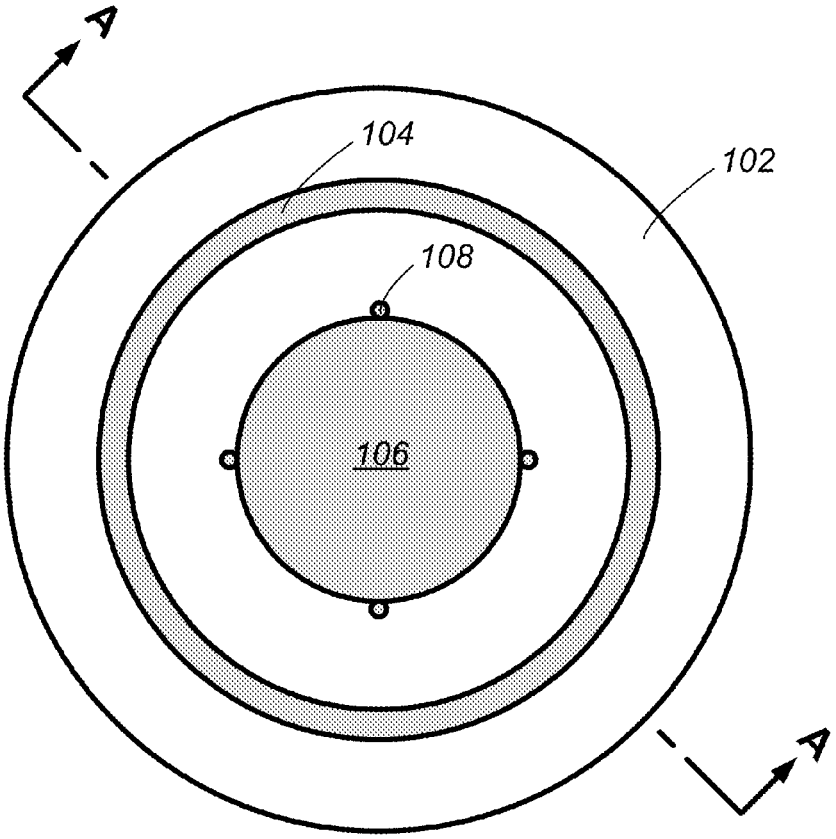
FIG. 1 is a simplified top view of a connect slot antenna in accordance with an embodiment.

FIG. 1 is a simplified top view of a connected-slot antenna in accordance with an embodiment. A circular patch 106 overlies a dielectric substrate 102. A conductive ring 104 also overlies the dielectric substrate 102 and surrounds the circular patch 106. The portion of the dielectric substrate 102 that extends between the circular patch 106 and the conductive ring 104 forms a connected slot. The dielectric substrate 102 provides electrical isolation between the circular patch 106 and conductive ring 104, both of which are electrically conducting.

The dielectric substrate 102 may comprise a non-conductive material such as a plastic or ceramic. The circular patch 106 and the conductive ring 104 may comprise a conductive material such as a metal or alloy. In some embodiments, the dielectric material may include a non-conductive laminate or pre-preg, such as those commonly used for printed circuit board (PCB) substrates, and the circular patch 106 and the conductive ring 104 may be etched from a metal foil in accordance with known PCB processing techniques.

In some embodiments, the circular patch 106 and the conductive ring 104 each have a substantially circular shape, and diameters of the circular patch 106 and the conductive ring 104, as well as a distance between the circular patch 106 and the conductive ring 104, may be determined based on a desired radiation pattern and operating frequency. In an embodiment, the dielectric substrate 102 is substantially the same shape as the conductive ring 104 and has a diameter that is the same as or greater than an outside diameter of the conductive ring 104. The circular patch 106 may be substantially planar in some embodiments or have a slight curvature in other embodiments. The slight curvature can improve low elevation angle sensitivity.

The connected-slot antenna in this example also includes four feeds 108 that are disposed in the connected slot and coupled to the circular patch 106. Other embodiments may include a different number of feeds (more or less). The feeds 108 provide an electrical connection between the circular patch 106 and a transmitter and/or receiver. The feeds 108 are disposed around a circumference of the circular patch 106 so that each feed 108 is spaced from adjacent feeds 108 by approximately equal angular intervals. The example shown in FIG. 1 includes four feeds 108, and each of the feeds 108 are spaced from adjacent feeds 108 by approximately 90°. For a connected-slot antenna with six feeds, the angular spacing would be approximately 60°; for a connected-slot antenna with 8 feeds, the angular spacing would be approximately 45°; and so on.

The placement of the feeds 108 around the circular patch 106 allows the feeds 108 to be phased to provide circular polarization. For example, signals associated with the four feeds 108 shown in FIG. 1 may each have a phase that differs from the phase of an adjacent feed by +90° and that differs from the phase of another adjacent feed by −90°. In an embodiment, the feeds are phased in accordance with known techniques to provide right hand circular polarization (RHCP). The number of feeds may be determined based on a desired bandwidth of the connected-slot antenna.

Figure 2:
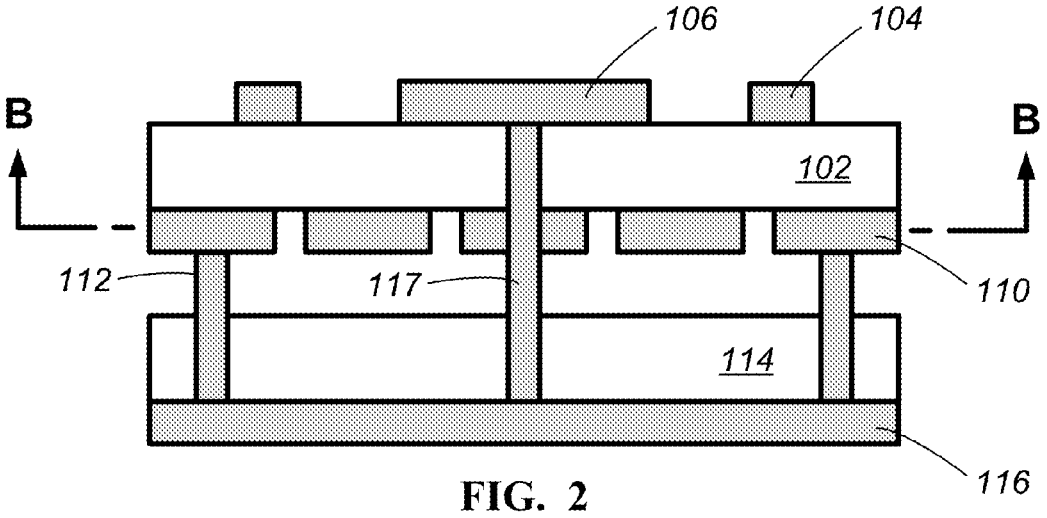
FIG. 2 is a simplified cross section along line A-A of the connected-slot antenna shown in FIG. 1 in accordance with an embodiment.

FIG. 2 is a simplified cross section along line A-A of the connected-slot antenna shown in FIG. 1 in accordance with an embodiment. This figure provides a cross-section view of the circular patch 106, the conductive ring 104, and the dielectric substrate 102. This figure shows a gap separating the circular patch 106 from the conductive ring 104. The gap may include air or another dielectric that provides electrical isolation between the circular patch 106 and the conductive ring 104.

This cross section also shows that the connected-slot antenna in this example includes conductive patches 110 on a backside of the dielectric substrate 102. The conductive patches 110 are separated from the circular patch 106 and the conductive ring 104 by the dielectric substrate 102. The conductive patches 110 may be separated from adjacent conductive patches 110 by a dielectric (e.g., air or another dielectric).

Figure 18:
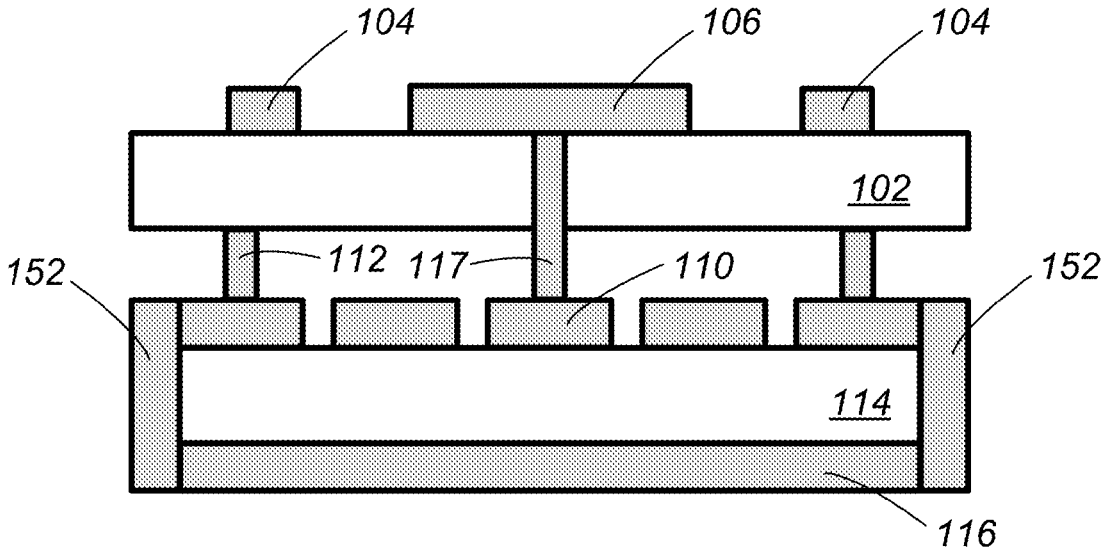

In some embodiments, the conductive patches 110 may be separated from the circular patch 106 and the conductive ring 104 by one or more additional dielectrics as well. As an example, the conductive patches 110 may be disposed on a top surface of dielectric 114 (as shown in FIG. 18) so that they are separated from the circular patch 106 and the conductive ring 104 by the dielectric substrate 102 plus another dielectric (e.g., air or another dielectric filling the gap between the dielectric substrate 102 and the dielectric 114). In yet other embodiments, the conductive patches 110 may be coupled to a backside of the dielectric substrate 102 and to a front side of the dielectric 114 (eliminating the gap).

FIG. 2 also shows a ground plane 116 that is electrically grounded and coupled to a first portion of the conductive patches 110 by first vias 112 and electrically isolated from a second portion of the conductive patches 110. In this example, the ground plane 116 is also coupled to one of the conductive patches 110 and to the circular patch 106 by a second via 117. As shown in FIG. 1, the circular patch 106 is coupled to the feeds 108 along a perimeter of the circular patch 106 to provide an active (radiating) element, and a center of the circular patch 106 may be coupled to ground by the second via 117.

The conductive patches 110, the first vias 112, the second via 117, and the ground plane 116 form a metamaterial ground plane. The metamaterial ground plane can provide an artificial magnetic conductor (AMC) with electromagnetic band-gap (EBG) behavior. This allows the metamaterial ground plane to be disposed at a distance of less than $\lambda/4$ from the circular patch 106 and the conductive ring 104 while still providing a constructive addition of the direct and reflected wave over the desired frequencies (e.g., 1.1-2.5 GHz). The metamaterial ground plane also provides surface wave suppression and reduces left hand circular polarized (LHCP) signal reception to improve the multipath performance over a wide bandwidth. With the metamaterial ground plane, antenna gain can be on the order of 7-8 dBi, with strong radiation in the upper hemisphere including low elevation angles, and negligible radiation in the lower hemisphere for enhanced multipath resilience.

The conductive patches 110, the first vias 112, the second via 117, and the ground plane 116 may comprise a conductive material such as a metal or alloy. In an embodiment, the conductive patches 110 and the ground plane 116 may be etched from a metal foil in accordance with known PCB processing techniques. The first vias 112 and the second via 117 may comprise a metal pin (solid or hollow) or may be formed using a via etch process that forms via holes through the dielectrics and then deposits a conductive material in the via holes.

The dielectric 114 may comprise an electrically non-conductive material such as a plastic or ceramic. In some embodiments, the dielectric 114 may include a non-conductive laminate or pre-preg, such as those commonly used as for PCB substrates.

In some embodiments, the second via 117 may extend only from the ground plane 116 to one of the conductive patches 110 in a manner similar to the first vias 112 in this example (rather than also extending through the dielectric substrate 102 to the circular patch 106). Examples of the center via extending only from the ground plane to one of the conductive patches are shown in FIGS. 16-17, where a via 112 extends only to one of the conductive patches 110. In these embodiments, the circular patch 106 is not coupled to ground. These different configurations are provided merely as examples, and each of the examples shown in FIGS. 2 & 14-18 may include (i) a second via that extends through the dielectric substrate and is coupled to the circular patch; (ii) a center via that extends only from the ground plane to one of the conductive patches; or (iii) no center via. In some embodiments, the vias provide structural support, and the particular configuration of the vias is determined at least in part based on desired structural features.

Also, in some embodiments, each of the conductive patches 110 may be coupled to the ground plane 116 using additional vias (instead of only some of the conductive patches 110 being coupled to the ground plane 116 as shown in the figures). Further, in some embodiments, the first vias 112 may extend through the dielectric substrate 102 like the second via 117. In these embodiments, the first vias 112 may either be coupled to the conductive ring 104 or may be isolated from the conductive ring 104.

Figure 3:
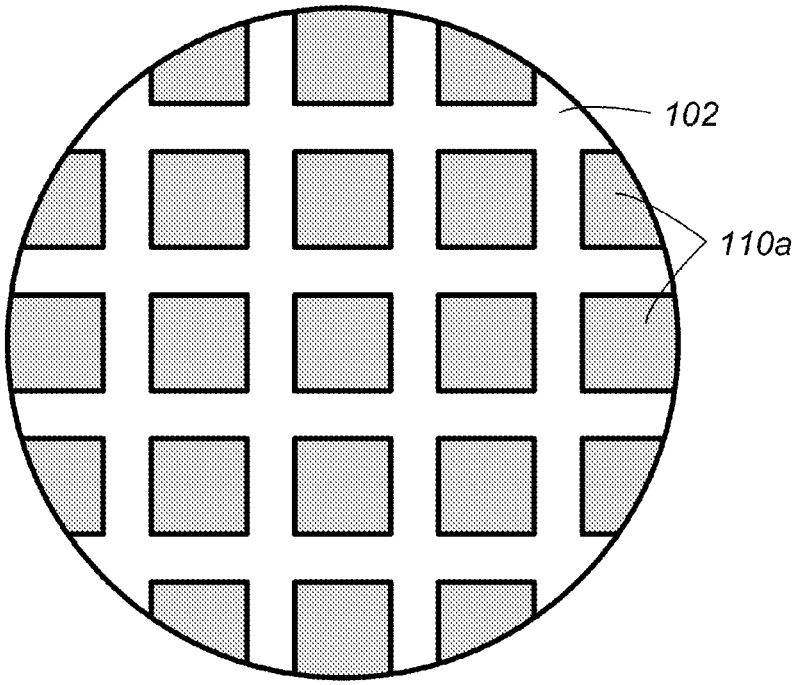
FIGS. 3-4 are simplified bottom views along line B-B of the connected-slot antenna shown in FIG. 2 in accordance some embodiments.
Figure 4:
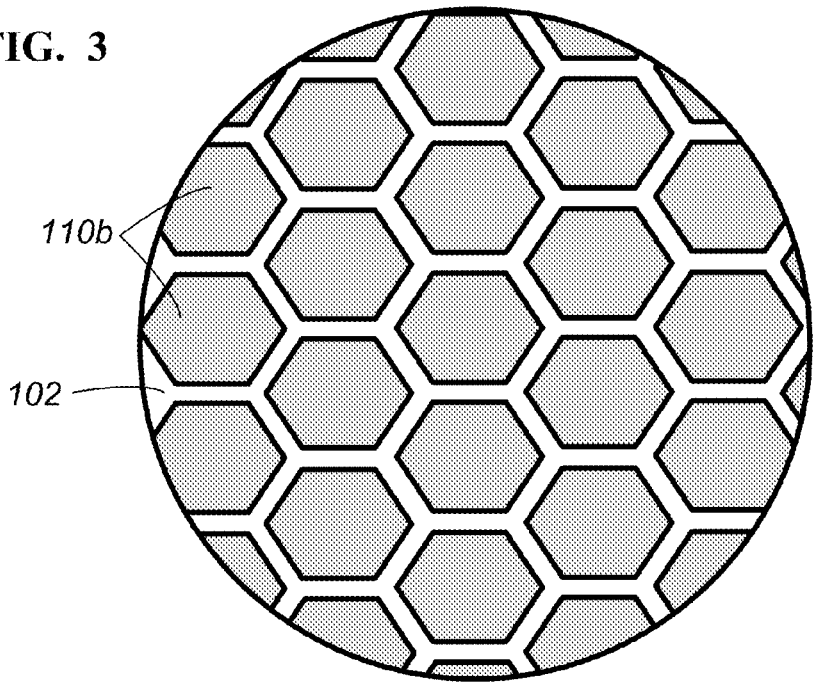

FIGS. 3-4 are simplified bottom views along line B-B of the connected-slot antenna shown in FIG. 2 in accordance some embodiments. FIG. 3 shows an array of conductive patches 110*a* each having a square-shape, and FIG. 4 shows a honeycomb arrangement of conductive patches 110*b* each having a hexagon-shape. These embodiments are provided merely as examples, and each of the conductive patches 110 may have any polygon or circular shape. Alternatively, each of the conductive patches 110 may have an arbitrary shape that includes a conductive pattern overlying a dielectric and ground pad. The shape, arrangement, and spacing of the conductive patches 110 may be determined in accordance with known techniques based on desired operating frequencies.

Figure 5:
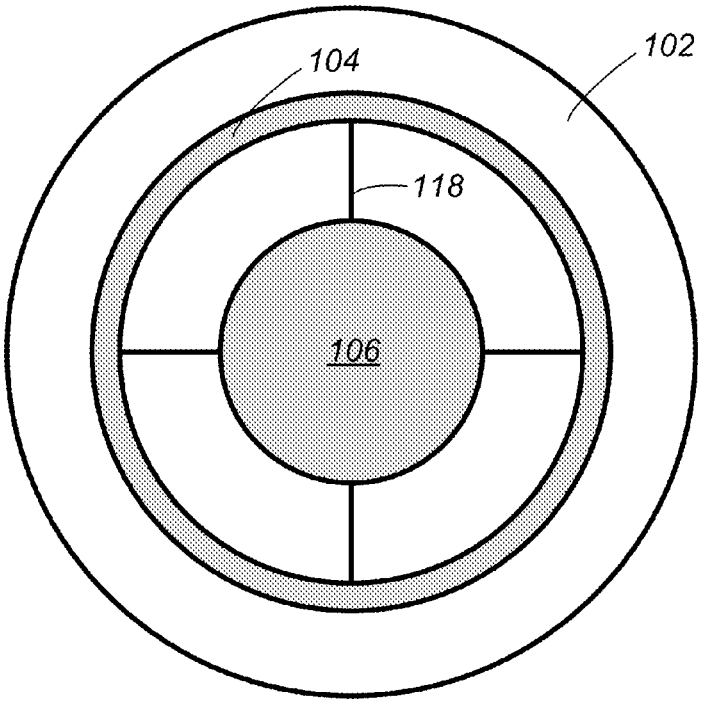
FIG. 5 is a simplified top view of a connected-slot antenna in accordance with another embodiment.

FIG. 5 is a simplified top view of a connected-slot antenna in accordance with another embodiment. This embodiment is similar to the example shown in FIG. 1 in that it includes a circular patch 106 and conductive ring 104 overlying a dielectric substrate 102. The feeds 118 in this example are different in that they include a conductive line (or trace) overlying the dielectric substrate. This arrangement facilitates use of transmission lines such as coaxial cables, each having a core coupled to the circular patch 106 and a ground coupled to the conductive ring 104. An opposite end of each transmission line is coupled to a transmitter and/or receiver. In some embodiments, the core may be coupled directly to the circular patch 106 and isolated from the feeds 118, and the feeds 118 may couple the ground to the conductive ring 104. In other embodiments, the ground may be coupled directly to the conductive ring 104 and isolated from the feeds 118, and the feeds 118 may couple the core to the conductive patch 106.

Like the example shown in FIG. 1, the feeds 118 are disposed around a circumference of the circular patch 106 so that each feed 118 is spaced from adjacent feeds 118 by approximately equal angular intervals. In this example, each of the four feeds 118 are spaced from adjacent feeds 118 by approximately 90°.

The feeds 118 in this example may comprise a conductive material such as a metal or alloy. In an embodiment, the feeds 118 may be etched from a metal foil in accordance with known PCB processing techniques. The circular patch 106, conductive ring 104, and dielectric substrate 102 may be arranged in a manner similar to that described above with regard to FIG. 1. This embodiment may also include any of the other features described above with regard FIG. 2 and described below with regard to FIGS. 14-18 (e.g., conductive patches, vias, ground plane, conductive fence, etc.).

Figure 6A:
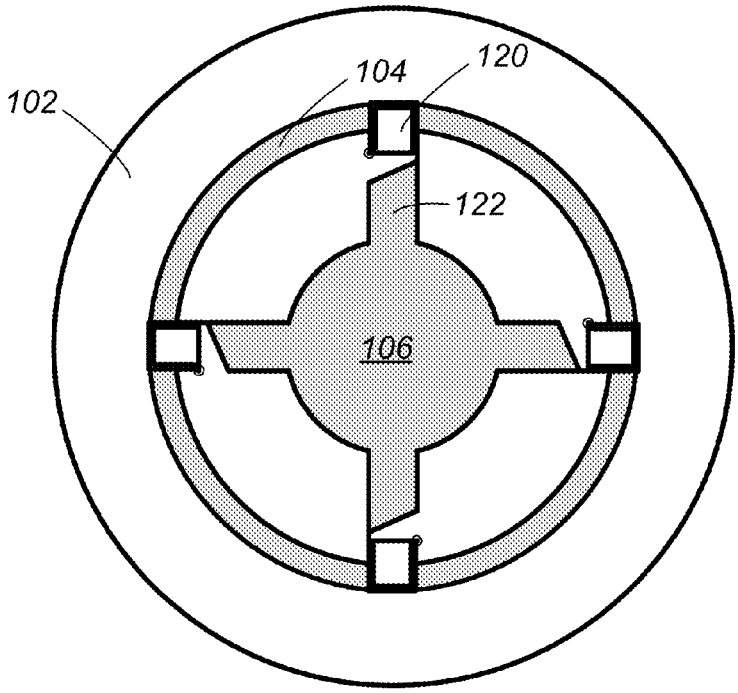
FIG. 6*a* is a simplified top view of a connected-slot antenna in accordance with another embodiment.

FIG. 6*a* is a simplified top view of a connected-slot antenna in accordance with another embodiment. This embodiment is similar to the example shown in FIG. 1 in that it includes a circular patch 106 and a conductive ring 104 overlying a dielectric substrate 102. This embodiment is different from the example shown in FIG. 1 in that it includes impedance transformers 120. The impedance transformers 120 perform load matching between an input and the antenna structure. In an embodiment, for example, a typical impedance at an input of a transmission line (e.g., a coaxial cable) may be approximately 50Ω, and an impedance of the antenna may be higher (e.g., approximately 100Ω, 200Ω, or more). Each impedance transformer 120 can be configured to convert the 50Ω to impedance of the antenna.

In the example shown in FIG. 6*a*, the conductive patch 106 also includes elongated sections 122 extending radially outward from a circular portion of the conductive patch 106. Each elongated section 112 is spaced from adjacent elongated sections 112 by approximately equal angular intervals. Each elongated section 122 is positioned adjacent to an output of one of the impedance transformers 120. The elongated sections 122 provide a connection between the output of the impedance transformers 120 and the conductive patch 106. The elongated sections 122 shown in FIG. 6*a* are provided merely as examples, and other embodiments that include elongated sections may use different sizes and shapes of elongated sections. The elongated sections 122 may comprise a conductive material such as a metal or alloy. In an embodiment, the elongated sections 122 may be etched from a metal foil in accordance with known PCB processing techniques.

Figure 6B:
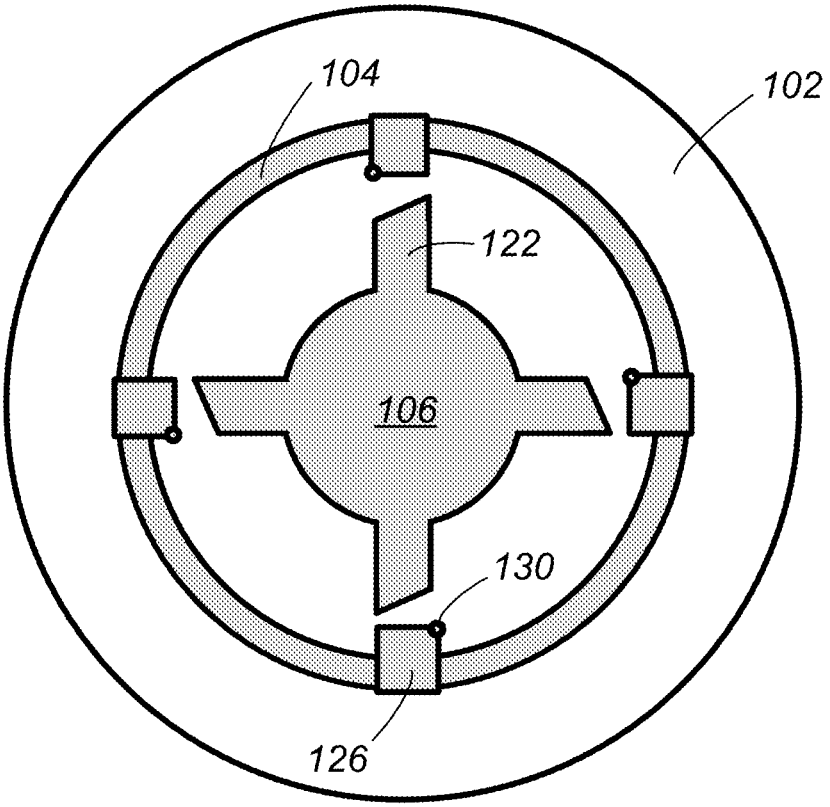
FIGS. 6*b*-6*c* are simplified top views of portions of the connected-slot antenna shown in FIG. 6*a* in accordance with some embodiments.

In an embodiment, the impedance transformers 120 each include a microstrip and ground pad that are separated by a dielectric. These features can be illustrated with reference to FIGS. 6*b*-6*c*, which are simplified top views of portions of the connected-slot antenna shown in FIG. 6*a* in accordance with some embodiments. In FIG. 6*b*, the microstrip and dielectric of the impedance transformers 120 are removed to expose ground pads 126. The ground pads 126 are electrically coupled to the conductive ring 104. Each ground pad 126 includes a small ring 130 for connection to ground. If a coaxial cable is used as a transmission line, a ground (or shield) may be coupled to the ground pad 126 at the small ring 130. This is shown and explained further with regard to FIG. 7.

Figure 6C:
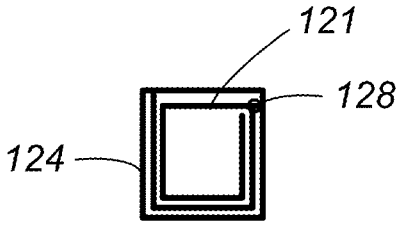

FIG. 6*c* shows a microstrip 121 on a dielectric 124. A microstrip 121 and dielectric 124 are configured to overly each of the ground pads 126. Each microstrip 121 and ground pad 126 are conductive, and the dielectric 124 provides electrical isolation between the microstrip 121 and ground pad 126. Each microstrip 121 includes an input 128 for connection to a feed. If a coaxial cable is used as a transmission line, a core may be coupled to the input 128. Each microstrip 121 includes at least two conductive traces. This is shown and explained further below with regard to FIGS. 8-11.

The ground pads 126 and microstrips 121 may comprise a conductive material such as a metal or alloy. In an embodiment, the ground pads 126 and microstrips 121 may be etched from a metal foil in accordance with known PCB processing techniques.

The circular patch 106, conductive ring 104, and dielectric substrate 102 may be arranged in a manner similar to that described above with regard to FIG. 1. This embodiment may also include any of the other features described above with regard FIG. 2 and described below with regard to FIGS. 14-18 (e.g., conductive patches, vias, ground plane, conductive fence, etc.).

Figure 7:
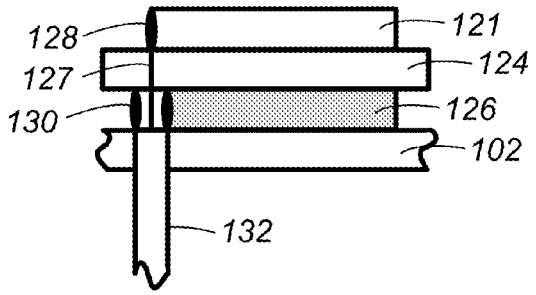
FIGS. 7-12 are simplified diagrams of impedance transformers, or portions of impedance transformers, in accordance with some embodiments.

FIG. 7 is a simplified cross section of an impedance transformer in accordance with an embodiment. A dielectric 124 (dielectric plate) separates the microstrip 121 from the ground pad 126. A transmission line 132 (e.g., a coaxial cable) extends through the dielectric substrate 102. The transmission line 132 includes a ground (or shield) that is coupled to the ground pad 126 at the small ring 130 and a core 127 that extends through the dielectric 124 and is coupled to the microstrip 121 at the input 128.

Figure 8:
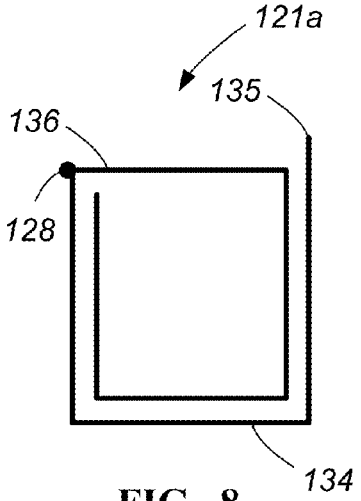

FIG. 8 is a simplified top view of a microstrip 121*a* in accordance with an embodiment. The microstrip 121*a* includes two conductive traces 134, 136. The first conductive trace 134 has one end coupled to an input 128 and another end coupled to an output 135. The input 128 is coupled to a feed (e.g., from a transmission line), and the output 135 is coupled to a conductive patch (e.g., conductive patch 106). The second conductive trace 136 has one end coupled to the input 128 and another end that is free from connection with a conductor. The first and second conductive traces 134, 136 extend substantially parallel to but separate from each other along multiple sections of the microstrip 121*a*. In this example, each section extends substantially perpendicular to an adjacent section.

Figure 9:
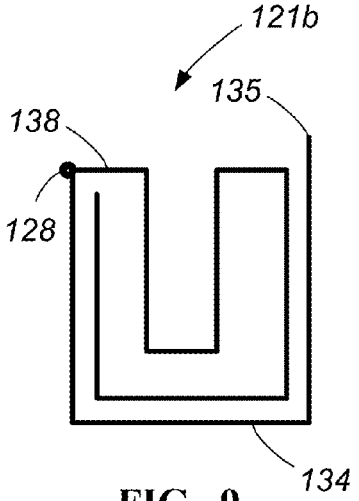
Figure 10:
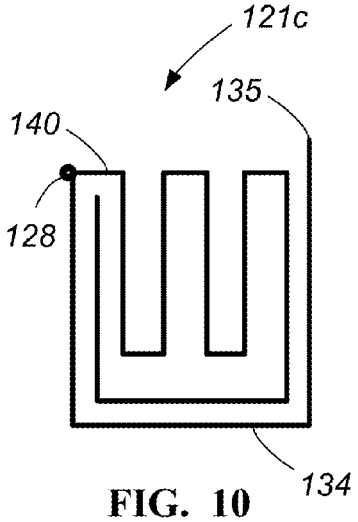
Figure 11:
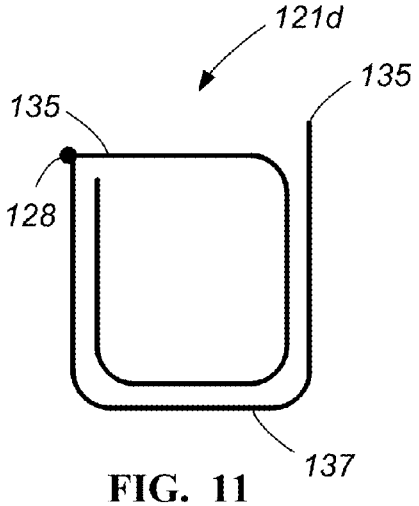

FIGS. 9-11 are simplified top views of microstrips in accordance with other embodiments. In the example shown in FIG. 9, a second conductive trace 138 of microstrip 121*b* is longer than the example shown in FIG. 8. The second conductive trace 138 has additional sections that extend parallel to other sections. In the example shown in FIG. 10, a second conductive trace 140 of microstrip 121*c* is longer than the example shown in FIG. 9. The second conductive trace 140 has even more sections that extend parallel to other sections. FIG. 11 is a simplified top view of a microstrip 121*d* in accordance with another embodiment. This example is similar to that of FIG. 8 but with rounded corners instead of sharp corners. The different shapes of the traces in FIGS. 8-11 are provided merely as examples, and the microstrips are not intended to be limited to these examples. A length of the two traces, spacing between the traces, and shape of the traces may be determined in accordance with known techniques based on desired matching characteristics.

Figure 12:
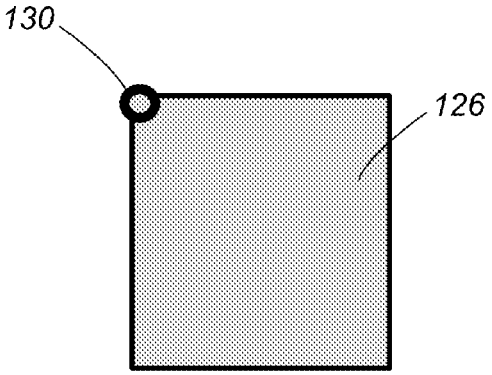

FIG. 12 is a simplified top view of a ground pad 126 in accordance with an embodiment. The ground pad 126 serves as a ground plane for the impedance transformer. This figure shows the small ring 130 for forming an electrical connection with ground. In an embodiment, the ground pad 126 is the same size or slightly larger than the main sections of the associated microstrip 121, and is arranged under the associated microstrip 121. The output 135 of an associated microstrip may extend beyond an edge of the ground pad 126.

Figure 13A:
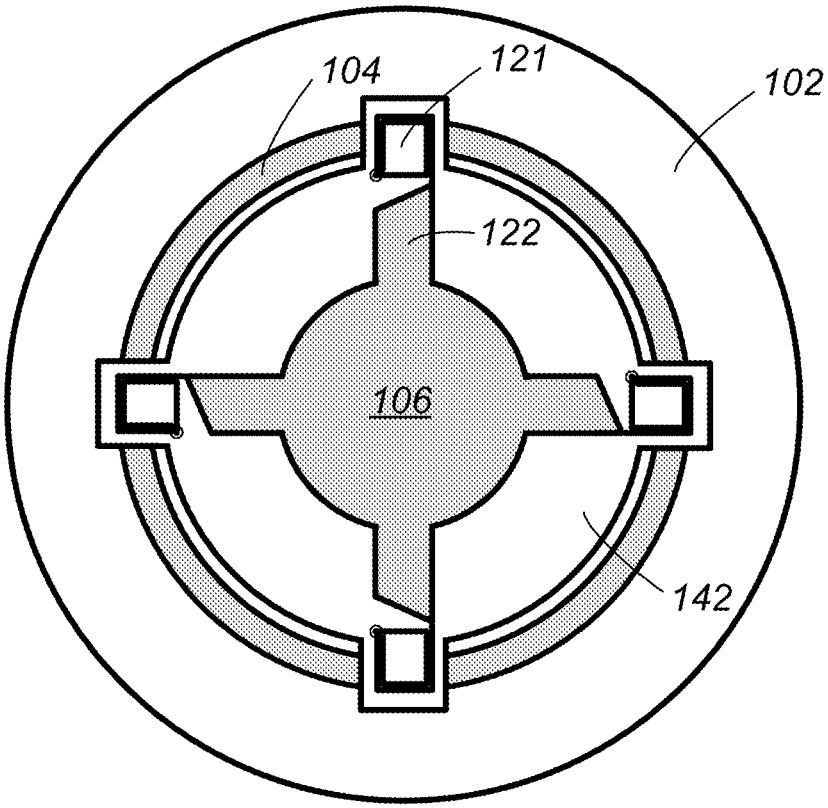
FIG. 13*a* is a simplified top view of a connected-slot antenna in accordance with another embodiment.
Figure 13B:
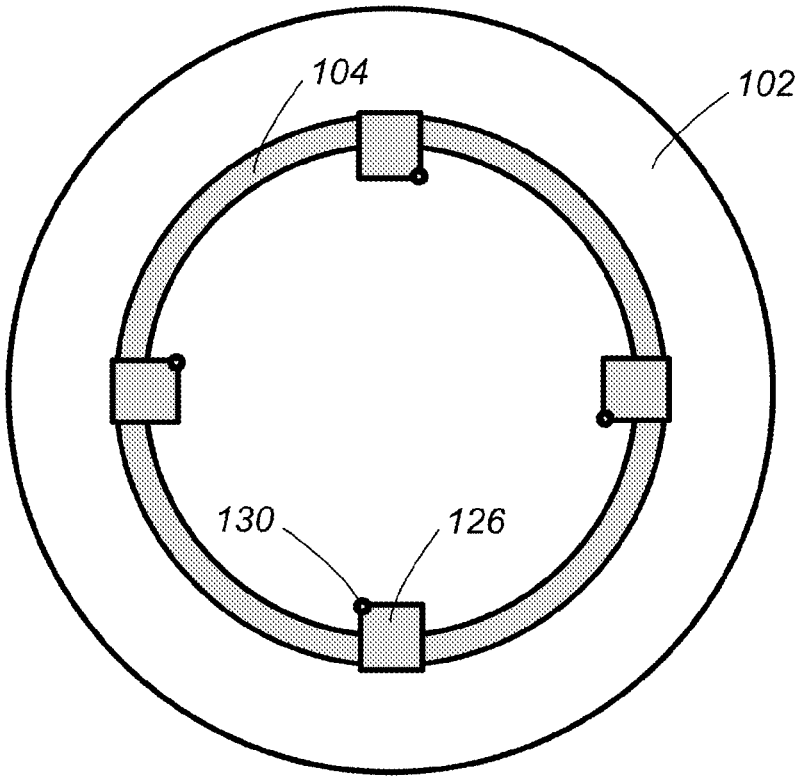
FIGS. 13*b*-13*c* are simplified top views of portions of the connected-slot antenna shown in FIG. 13*a* in accordance with some embodiments.
Figure 13C:
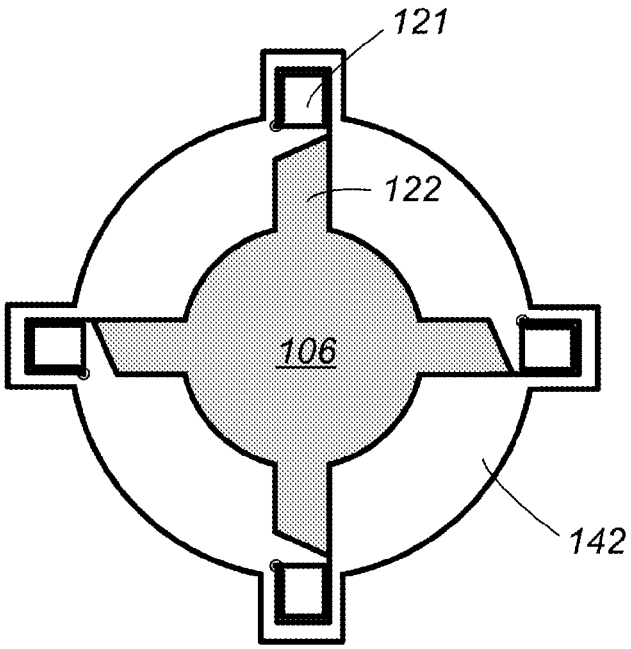

FIG. 13*a* is a simplified top view of a connected-slot antenna in accordance with another embodiment. This embodiment is similar to the embodiment shown in FIG. 6*a*, but a circular patch 106, elongated sections 122, and microstrips 121 overly a dielectric disc 142, and a conductive ring 104 and ground pads 126 overly a dielectric substrate 102. This is shown more clearly in FIGS. 13*b*-13*c*. FIG. 13*b* shows the conductive ring 104 and ground pads 126 overlying the dielectric substrate 102, and FIG. 13*c* shows the circular patch 106, elongated sections 122, and microstrips 121 overlying the dielectric disc 142. In this example, the conductive patches and ground plane (not shown) are separated from the circular patch by at least the dielectric substrate 102 and the dielectric disc 142.

FIGS. 14-18 are simplified cross sections of connected-slot antennas in accordance with some embodiments. These figures are intended to show some of the different features of the connected-slot antennas. Rather than showing every possible configuration, it should be appreciated that the features from one figure can be combined with features from other figures. Also, as described above with regard to FIG. 2, the first and second vias 112, 117 may or may not extend through dielectric substrate 102 in some embodiments.

Figure 14:
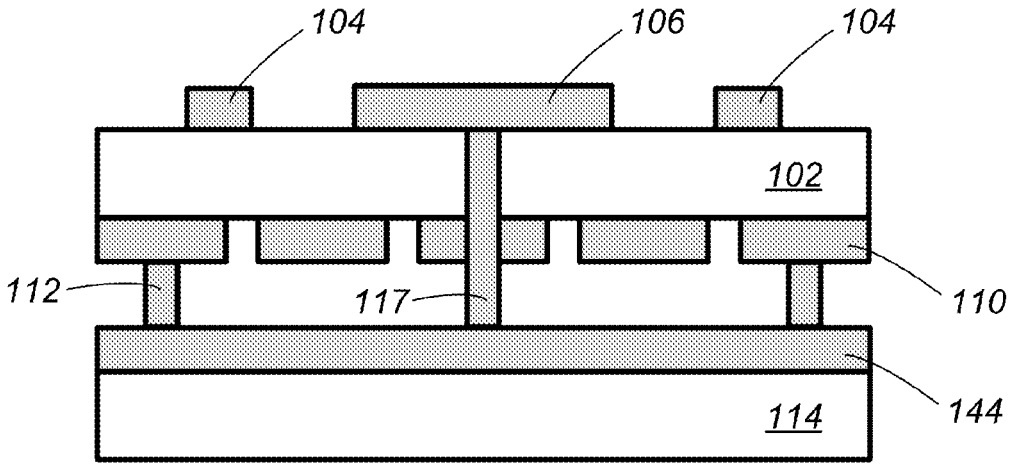
FIGS. 14-18 are simplified cross sections of connected-slot antennas in accordance with some embodiments.

FIG. 14 shows a connected-slot antenna with a ground plane 144 that overlies a dielectric 114 in accordance with an embodiment. This example is similar to that of FIG. 2, except that the ground plane 144 overlies (instead of underlies) the dielectric 114. In this example, the conductive patches 110 are only separated from the ground plane 144 by a gap between them. This gap may be filled with air or another dielectric. The exact configuration of the ground plane (over or under the dielectric 114) can be determined based on a desired size and intended use of the connected-slot antenna.

Figure 15:
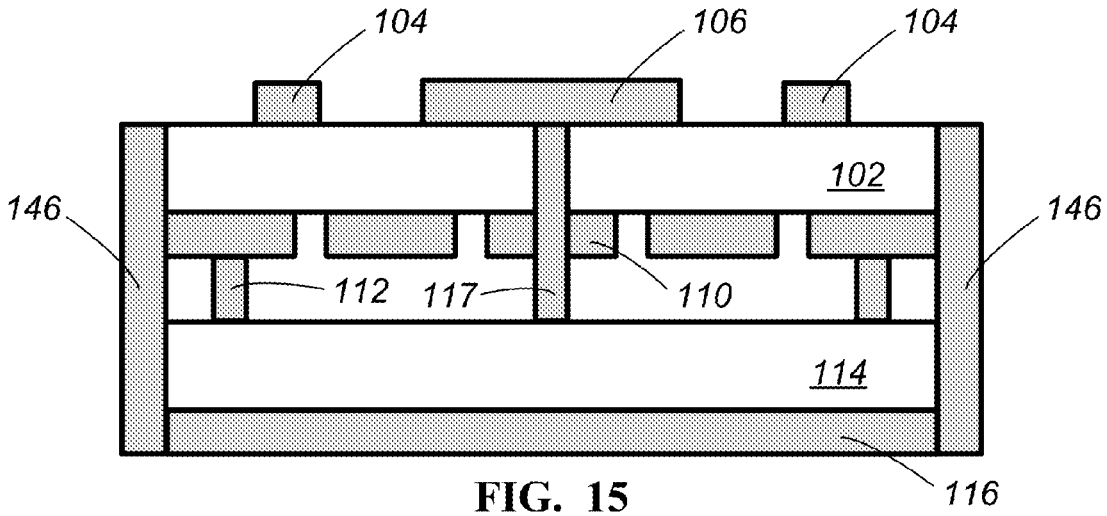
Figure 16:
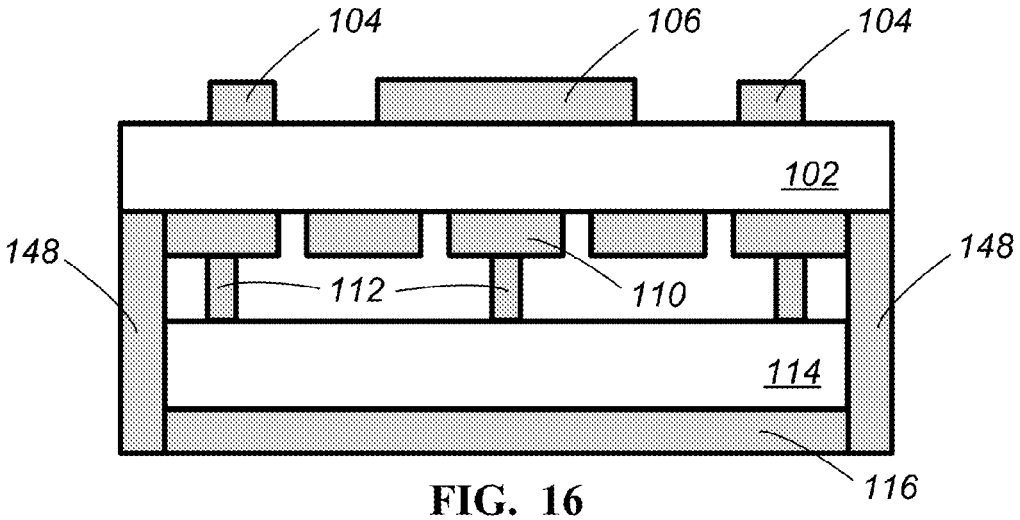
Figure 17:
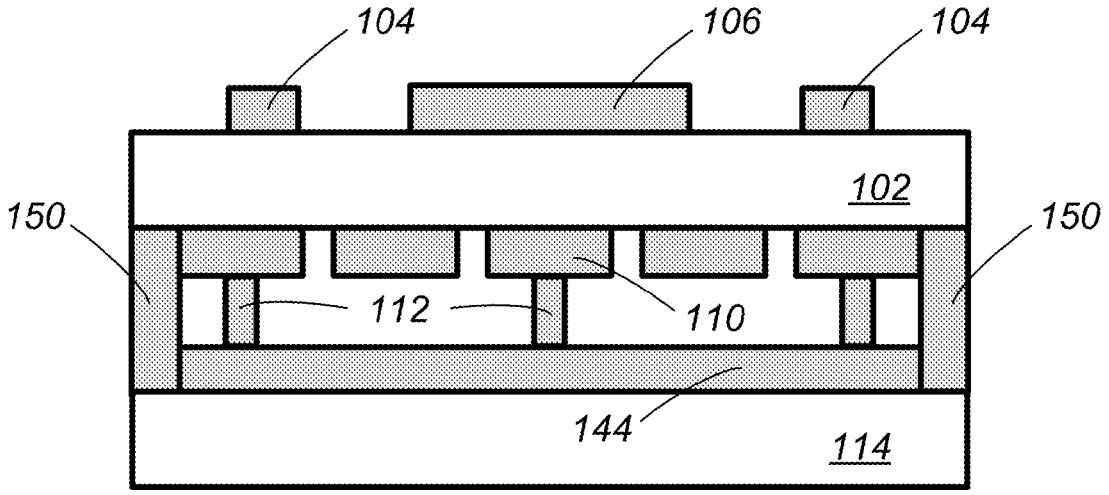

FIGS. 15-16 are shown with a ground plane 116 that underlies a dielectric 114, but in other embodiments the examples shown in these figures could instead have a ground plane 144 that overlies the dielectric 114.

FIG. 15 shows a connected-slot antenna with a conductive fence 146 in accordance with another embodiment. The conductive fence 146 extends around a perimeter of the conductive patches 110 and around a perimeter of the ground plane 116. In this example, the conductive fence 146 also extends around a perimeter of the dielectric substrate 102 and the dielectric 114.

The conductive fence may be considered to be part of a metamaterial ground plane (along with conductive patches and a ground plane). The conductive fence can eliminate discontinuities at the edges of the conductive patches and the ground plane and form a cavity. This can reduce residual surface waves by shorting them to ground. The conductive fence improves LHCP isolation, low elevation angle sensitivity, antenna bandwidth, and multipath resilience.

The conductive fence 146 may comprise a conductive material such as a metal or alloy and may be electrically grounded. In an embodiment, the conductive fence 146 is shaped like a band that surrounds the conductive patches 110 and the ground plane. The conductive fence 146 may abut a portion of the conductive patches 110 (those conductive patches 110 that are disposed along a perimeter) and the ground plane 116.

FIG. 16 shows a connected-slot antenna with a conductive fence 148 in accordance with another embodiment. In this example, the conductive fence 148 also extends around a perimeter of the conductive patches 110 and around a perimeter of the ground plane (which could be either over or under dielectric 114). The conductive fence 148 does not, however, extend around a perimeter of the dielectric substrate 102. Instead, the conductive fence 148 extends to a bottom of the dielectric substrate 102. Also, in this example, a center via only extends from the ground plane to one of the conductive patches 110 (rather than through the dielectric substrate 102). This is shown merely to illustrate a feature that may be used with any of the embodiments. No specific relationship is intended between the shorter center via and the conductive fence 148 shown in this example. This embodiment may be more compact, lighter, and cheaper to produce than the embodiment shown in FIG. 15 because the conductive fence 148 is shorter.

In this example, conductive patches 110 are arranged along a first plane, and the ground plane 116 is arranged along a second plane. The conductive fence 148 extends from the first plane to the second plane and around a perimeter of the conductive patches 110 and a perimeter of the ground plane 116. A major surface of the conductive fence 148 extends substantially perpendicular to the first plane and the second plane.

FIG. 17 shows a connected-slot antenna with a conductive fence 150 in accordance with another embodiment. This example includes conductive patches 110 arranged along a first plane and a ground plane 144 arranged along a second plane. Similar to FIG. 16, the conductive fence 150 extends from the first plane to the second plane and around a perimeter of the conductive patches 110 and a perimeter of the ground plane 144.

FIG. 18 shows a connected-slot antenna with a conductive fence 152 in accordance with another embodiment. In this example, conductive patches 110 are disposed along a top surface of dielectric 114, and a ground plane 116 is disposed along a bottom surface of the dielectric 114. Similar to the previous examples, the conductive patches 110 are arranged along a first plane, the ground plane 116 is arranged along a second plane, and the conductive fence 152 extends from the first plane to the second plane and around a perimeter of the conductive patches 110 and a perimeter of the ground plane 116.

Figure 19:
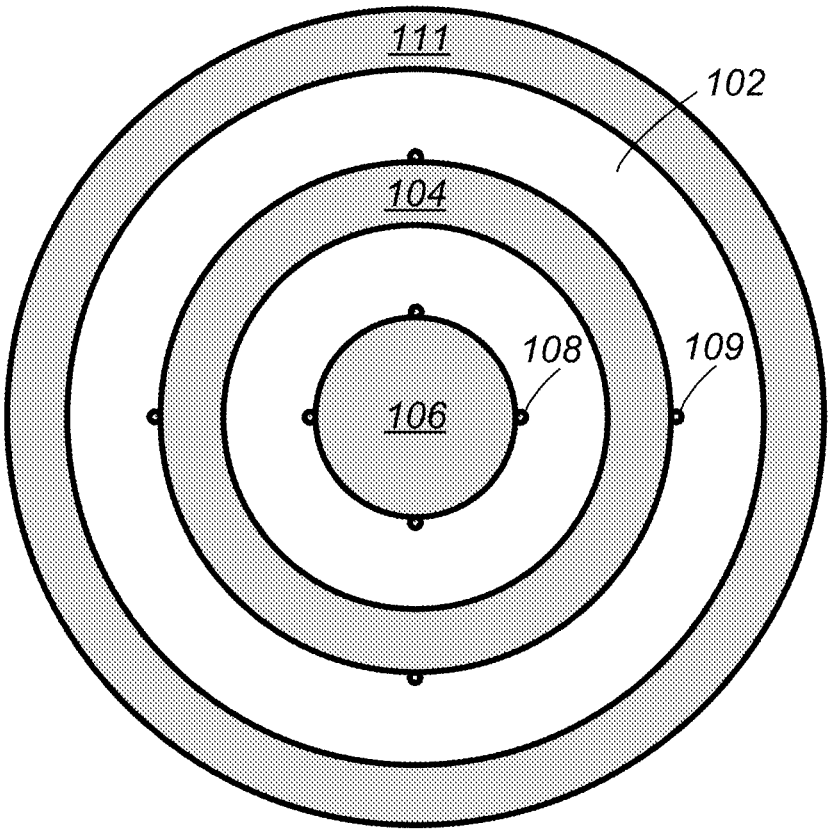
FIG. 19 is a simplified top view of a connect slot antenna in accordance with an embodiment.

FIG. 19 is a simplified top view of a connect slot antenna in accordance with an embodiment. This example is similar to previous examples in that it includes a circular patch 106 and conductive ring 104 overlying a dielectric substrate 102. This example also includes four feeds 108 coupled to the circular patch 106. This example is different from the previous examples in that it includes a second conductive ring 111 overlying the dielectric substrate 102 and surrounding the first conductive ring 104. Also, second feeds 109 are coupled to the first conductive ring 104.

In this example, the circular patch 106 and the first conductive ring 104 are separated by a first connected slot, and the first conductive ring 104 and the second conductive ring 111 are separated by a second connected slot. Like the first feeds 108, the second feeds 109 are spaced from adjacent second feeds 109 by approximately equal angular intervals.

This example is provided as an embodiment that includes multiple conductive rings. Other embodiments may include additional conductive rings with additional feeds. The number of conductive rings and the number of feeds may be determined based on desired operating frequency bands.

While the present invention has been described in terms of specific embodiments, it should be apparent to those skilled in the art that the scope of the present invention is not limited to the embodiments described herein. For example, features of one or more embodiments of the invention may be combined with one or more features of other embodiments without departing from the scope of the invention. The specification and drawings are, accordingly, to be regarded in an illustrative rather than a restrictive sense. Thus, the scope of the present invention should be determined not with reference to the above description, but should be determined with reference to the appended claims along with their full scope of equivalents.

What is claimed is:

1. A circularly polarized connected-slot antenna configured to receive radiation at global navigation satellite system (GNSS) frequencies, comprising:

a dielectric substrate;

a circular patch overlying the dielectric substrate;

a first conductive ring surrounding the circular patch and overlying the dielectric substrate, the first conductive ring separated from the circular patch by a first connected slot;

at least four impedance transformers overlying the dielectric substrate, each of the at least four impedance transformers including a microstrip and a ground pad that are separated by a first dielectric, each microstrip comprising at least two conductive traces, a first one of the at least two conductive traces having one end coupled to a first feed from a coaxial cable at an input and another end coupled to the circular patch at an output, a second one of the at least two conductive traces having one end coupled to the first feed and another end free from connection with a conductor, and each ground pad coupled to a ground from the coaxial cable and coupled to the first conductive ring, wherein the output associated with each microstrip is spaced from adjacent outputs associated with other microstrips by approximately equal angular intervals; and a metamaterial ground plane comprising:

a plurality of conductive patches arranged along a first plane and separated from the circular patch, the first conductive ring, and the at least four impedance transformers by at least the dielectric substrate, each conductive patch separated from others of the conductive patches;

a ground plane arranged along a second plane, the ground plane electrically coupled to at least a first portion of the plurality of conductive patches; and a conductive fence extending at least from the first plane to the second plane and extending around a perimeter of the plurality of conductive patches and around a perimeter of the ground plane, wherein one or more of the plurality of conductive patches, the ground plane, and the conductive fence are coupled to ground.

2. The circularly polarized connected-slot antenna of claim 1 wherein the circular patch and the first conductive ring each having a substantially circular shape.

3. The circularly polarized connected-slot antenna of claim 1 further comprising:

a second conductive ring surrounding the first conductive ring and overlying the dielectric substrate, the second conductive ring separated from the first conductive ring by a second connected slot; and a plurality of second feeds coupled to the second conductive ring, each of the plurality of second feeds spaced from adjacent ones of the plurality of second feeds by approximately equal angular intervals.

4. The circularly polarized connected-slot antenna of claim 1 wherein the first conductive trace and the second conductive trace extend substantially parallel to but separate from each other along multiple sections of the microstrip, each section of the microstrip extending substantially perpendicular to an adjacent section of the microstrip.

5. The circularly polarized connected-slot antenna of claim 1 wherein the ground plane is electrically isolated from at least a second portion of the plurality of conductive patches.

6. The circularly polarized connected-slot antenna of claim 1 wherein the circular patch, the first conductive ring, and the at least four impedance transformers overly a top side of the dielectric substrate, and the plurality of conductive patches are disposed on a backside of the dielectric substrate.

7. The circularly polarized connected-slot antenna of claim 1 wherein the circular patch includes at least four elongated sections extending radially outward from the circular patch and spaced at approximately equal angular intervals around the circular patch, each of the at least four elongated sections coupled to a microstrip at the output of the microstrip, and each microstrip disposed outward beyond an end of an associated one of the at least four elongated sections.

8. The circularly polarized connected-slot antenna of claim 1 further comprising a second dielectric disposed between the plurality of conductive patches and the ground plane.

9. The circularly polarized connected-slot antenna of claim 1 wherein the first dielectric comprises a dielectric disc, and the circular patch and each microstrip overly the dielectric disc.

10. The circularly polarized connected-slot antenna of claim 1 wherein the first dielectric comprises multiple dielectric plates, and each microstrip is separated from an associated ground pad by one of the multiple dielectric plates.

11. The circularly polarized connected-slot antenna of claim 1 wherein a major surface of the conductive fence extends substantially perpendicular to the first plane and the second plane.

12. The circularly polarized connected-slot antenna of claim 1 wherein the dielectric substrate and the ground plane are circular shaped, and the conductive fence extends around perimeters of the dielectric substrate and the ground plane.

13. A connected-slot antenna, comprising:

a dielectric substrate;

a circular patch overlying the dielectric substrate;

a first conductive ring surrounding the circular patch and overlying the dielectric substrate, the first conductive ring coupled to ground and isolated from the circular patch by a first connected slot;

at least four feeds coupled to the circular patch, each of the at least four feeds spaced from adjacent ones of the at least four feeds by approximately equal angular intervals;

a metamaterial ground plane comprising:

a plurality of conductive patches arranged along a first plane and separated from the circular patch and the first conductive ring by at least the dielectric substrate;

a ground plane arranged along a second plane, the ground plane electrically coupled to at least a first portion of the plurality of conductive patches, wherein one or more of the plurality of conductive patches and the ground plane are coupled to ground; and a conductive fence extending at least from the first plane to the second plane and extending around a perimeter of the plurality of conductive patches and around a perimeter of the ground plane, wherein the conductive fence is electrically coupled to a second portion of the plurality of conductive patches and to the ground plane, and one or more of the plurality of conductive patches, the ground plane, and the conductive fence are coupled to ground.

14. The connected-slot antenna of claim 13 further comprising at least four impedance transformers overlying the dielectric substrate, each of the at least four impedance transformers including a microstrip and a ground pad that are separated by a first dielectric, each microstrip coupled to one of the at least four feeds, and each ground pad coupled to ground.

15. The connected-slot antenna of claim 13 wherein the circular patch is electrically coupled to at least one of the plurality of conductive patches and to the ground plane by a via.

16. The connected-slot antenna of claim 13 further comprising:

a second conductive ring surrounding the first conductive ring and overlying the dielectric substrate, the second conductive ring isolated from the first conductive ring by a second connected slot; and a plurality of second feeds coupled to the second conductive ring, each of the plurality of second feeds spaced from adjacent ones of the plurality of second feeds by approximately equal angular intervals.

17. An antenna configured to receive radiation at global navigation satellite system (GNSS) frequencies, comprising:

a dielectric substrate;

a circular patch overlying the dielectric substrate;

a first conductive ring surrounding the circular patch and overlying the dielectric substrate;

a first connected slot extending between the circular patch and the first conductive ring and separating the circular patch from the first conductive ring;

at least four impedance transformers overlying the dielectric substrate, each of the at least four impedance transformers including a microstrip and a ground pad that are separated by a first dielectric, each microstrip comprising at least two conductive traces, a first one of the at least two conductive traces having one end coupled to a first input feed at an input and another end coupled to the circular patch at an output, a second one of the at least two conductive traces having one end coupled to the first input feed and another end free from connection with a conductor, wherein the output associated with each microstrip is separated from adjacent outputs associated with other microstrips by approximately equal angular intervals; and a metamaterial ground plane comprising:

a plurality of conductive patches arranged along a first plane and separated from the circular patch, the first conductive ring, and the at least four impedance transformers by at least the dielectric substrate; and a ground plane arranged along a second plane, the ground plane electrically coupled to at least a first portion of the plurality of conductive patches, wherein one or more of the plurality of conductive patches and the ground plane are coupled to ground.

18. The antenna of claim 17 further comprising a conductive fence extending at least from the first plane to the second plane and extending around a perimeter of the plurality of conductive patches and around a perimeter of the ground plane.

19. The antenna of claim 17 further comprising:

a second conductive ring surrounding the first conductive ring and overlying the dielectric substrate, the second conductive ring isolated from the first conductive ring by a second connected slot; and a plurality of second input feeds disposed in the second connected slot and coupled to the second conductive ring, each of the plurality of second input feeds separated from adjacent ones of the second input feeds by approximately equal angular intervals.

* * * * *